US005667362A

United States Patent [19]

Murai et al.

[11] Patent Number: 5,667,362

[45] Date of Patent: Sep. 16, 1997

[54] PUMP SYSTEM AND METHOD FOR OPERATING THE SAME

[75] Inventors: Yukio Murai; Seiichi Toguchi, both of Kanagawa-ken, Japan

[73] Assignee: Ebara Corporation, Tokyo, Japan

[21] Appl. No.: 216,427

[22] Filed: Mar. 23, 1994

[30] Foreign Application Priority Data

Mar. 30, 1993 [JP] Japan ..... 5-095663

[51] Int. Cl.[6] ..... F04B 49/00

[52] U.S. Cl. ..... 417/41; 417/44.1

[58] Field of Search ..... 417/41, 36, 40, 417/45, 53, 42, 44.1

[56] References Cited

U.S. PATENT DOCUMENTS 3,095,818 7/1963 Nobles et al. .
4,171,186 10/1979 Chapman .
4,370,098 1/1983 McClain et al. ..... 417/18
4,560,323 12/1985 Orchard ..... 417/41

FOREIGN PATENT DOCUMENTS 0 100 390 3/1987 European Pat. Off. .
60243701 3/1985 Japan .
566887 11/1944 United Kingdom ..... 417/41

OTHER PUBLICATIONS

World Pumps, Mar. 1993, 318:9–11, *Grundfos pumps with new technology.*

*Primary Examiner*—Timothy Thorpe
*Assistant Examiner*—Xuan M. Thai
*Attorney, Agent, or Firm*—Armstrong, Westerman, Hattori, McLeland & Naughton

[57] ABSTRACT

A pump system comprising a pump having a centrifugal impeller driven by an electric motor, a pair of upper and lower float switches for detecting a high water level HWL and a low water level LWL, respectively, a controller for outputting a control signal on the basis of preset rotational speeds for low and high-speed operations and a preset rotational speed increment rate, together with output signals from the upper and lower float switches, and a frequency converter for varying the rotational speed of the electric motor on the basis of the control signal from the controller, the pump system is capable of exhibiting the required pumping performance and of controlling the flow rate and the pump head.

24 Claims, 8 Drawing Sheets

14
U
V
W
15
77
16
Q5
G5
Q6
G6
Q3
G3
Q4
G4
Q1
G1
Q2
G2
53
S
R
52
P
N
51
(G1 to G6)
62
DRIVER
56
FREQUENCY CONVERTER CONTROL UNIT
61
D/A CONVERTER
60
COMMON BUS
CPU
59
INTERFACE
58
63
57
12,13

(B)

PUMP SYSTEM AND METHOD FOR OPERATING THE SAME

BACKGROUND OF THE INVENTION

1. Field of the Art

The present invention relates to a pump system and a method for operation thereof and, more particularly, to a pump system which is installed, for example, in a flow control tank of small-sized combined septic tank equipment.

2. Prior Art

Standardization of small-sized combined septic tanks has heretofore been promoted for the purpose of preventing water pollution of rivers, lakes and marshes. FIG. 8 schematically shows small-sized combined septic tank equipment in which a conventional pump is installed. As illustrated in the figure, sewage flowing into a flow control tank 2 from a raw sewage tank 1 is supplied to an anaerobic tank 4 by a pump 3, and the sewage is purified in the anaerobic tank 4 and an aerobic contact aeration tank 5 and is then discharged.

As the pump 3 employed for the above-described purpose, a rubber vane submersible pump or a small-output, general-purpose submersible sanitary sewage pump or non-clogging sewage pump has heretofore been used.

The above-described rubber vane submersible pump is a positive-displacement pump, which rotates at relatively low speed. Therefore, it has the advantageous feature that a low flow rate can readily be obtained and an approximately constant pump discharge can be obtained independently of the pump head. Accordingly, it is possible to construct small-sized combined septic tank equipment without providing a flow control device 6 for controlling the flow rate of sewage supplied from the flow control tank 2 to the anaerobic tank 4 by the pump 3.

However, in order to reduce the wear of the rubber vane of the rubber vane submersible pump and to thereby ensure a predetermined lifetime, it is necessary to use a special motor having a multipolar structure, such as a 12-pole motor. Thus, the conventional system suffers from the problem that the product cost of the pump is disadvantageously high. In addition, it is impossible to avoid an increase in power consumption due to friction occurring in the rubber vane part, and it is also difficult to overcome internal friction. Accordingly, the conventional system including a rubber vane submersible pump gives rise to the problem that electric power consumption is high and a long operation lifetime cannot be expected. Further, since this type of pump generates a high-pitched noise, the small-sized combined septic tank equipment, which is likely to be installed near a residential area, may cause a noise problem.

On the other hand, when a submersible sanitary sewage pump is used, the following problems arise: The pump discharge required for the pump 3, which is used in the flow control tank 2 of the small-sized combined septic tank equipment, is relatively small for example, 20 lit/min, whereas the pump discharge of a submersible sanitary sewage pump is excessively high; even the smallest of those which are commercially available at the present time has a pump discharge in the order of 100 lit/min. The reason for this is as follows: Since the structure of submersible sanitary sewage pumps is the same as that of general centrifugal pumps, it is difficult to reduce the size of a submersible sanitary sewage pump to achieve a low flow rate while ensuring a choke-proof pumping performance. Accordingly, when this type of pump is used, it is necessary to provide a flow control device 6 on the discharge side of the pump 3, as shown in FIG. 8, to return the greater part of sewage to the flow control tank 2, thereby supplying a controlled amount of sewage to the anaerobic tank 4. Thus, since it is difficult to reduce the size of the above type of submersible pump and the flow control device 6 is needed, electric power consumption is disadvantageously high and the cost of the equipment is relatively high.

Therefore, it has heretofore been demanded to provide a small-sized waste pump system which is conformable to small-sized combined septic tank equipment.

In view of the above-described circumstances, it is an object of the present invention to provide a small-sized pump system which is capable of exhibiting the required pumping performance and of controlling the flow rate and the pump head and which is free from the above mentioned power consumption, cost, wear and noise problems.

Another object of the present invention is to provide a method for operating a small-sized pump system which is capable of accomplishing the same object.

SUMMARY OF THE INVENTION

To attain the above-described first object, the present invention provides a pump system including:

- a pump having a centrifugal impeller rotated by means of an electric motor;
- a liquid level detector for detecting a liquid level;
- a controller for outputting a control signal on the basis of preset rotational speeds and a preset rotational speed increment rate, together with an output signal from said liquid level detector, and
- a frequency converter for varying the rotational speed of said electric motor on the basis of said control signal from said controller, wherein said preset rotational speeds include at least speeds for low and high-speed operations of said pump and said rotational speed of said electric motor is varied with said preset rotational speed increment rate from said low-speed operation to said high-speed operation.

The liquid level includes predetermined high and low-liquid levels, and said electric motor may be driven at said preset low-speed operation at said predetermined high-liquid level and may be suspended at said predetermined low-liquid level.

The liquid level detector may include a pair of upper and lower float switches.

The pump system is preferably a submersible pump system, wherein said controller and frequency converter are incorporated in said pump.

The pump system may further comprise means for detecting choking of said pump, and said controller outputs a control signal when said pump is choked. Then, said electric motor tries to start said choked pump, and if said pump does not clear, said electric motor repeatedly retries to start said pump after stopping for a predetermined time. If said pump still does not clear after a predetermined number of attempts at restarting, the operation of said electric motor is suspended.

Alternatively, if said pump does not clear, the second and subsequent attempts to start it may be carried out by reversely rotating said electric motor.

The pump system is preferably used as a submersible motor pump system in a small-sized combined septic tank equipment including a raw sewage tank, a flow control tank, an anaerobic tank and an aerobic contact aeration tank arranged in series and, wherein said pump system is installed in said flow control tank for supplying sewage from said flow control tank into said anaerobic tank.

The above-described second object is accomplished by the present invention which provides a method for operating a pump system comprising a pump having a centrifugal impeller driven to rotate by an electric motor; said method comprising steps of detecting a liquid level to be pumped out;

outputting a control signal on the basis of preset rotational speeds and a preset rotational speed increment rate, together with said detected liquid level, and varying the rotational speed of said electric motor on the basis of said output control signal, wherein said preset rotational speeds include at least speeds for low and high-speed operations of said pump and said rotational speed of said electric motor is varied with said preset rotational speed increment rate from said low-speed operation to said high-speed operation.

The liquid level includes predetermined high and low-liquid levels, and said electric motor may be driven at said preset low-speed operation at said predetermined high-liquid level and is suspended at said predetermined low-liquid level.

The method for operating a pump system may further comprises steps of detecting choking of said pump, and trying said electric motor to start said choked pump when said pump is choked.

The electric motor repeatedly tries to start said pump after stopping for a predetermined time if said pump does not clear, and the operation of said electric motor is suspended if said pump still does not clear after a predetermined number of attempts at restarting.

Alternatively, the second and subsequent attempts to restart it can be carried out by reversely rotating said electric motor if said pump does not clear.

The method of operating a pump system is preferably used in small-sized combined septic tank equipment including a raw sewage tank, a flow control tank, an anaerobic tank and an aerobic contact aeration tank arranged in series, wherein said pump system is installed in said flow control tank for supplying sewage from said flow control tank into said anaerobic tank, wherein said pump system is operated in accordance with the method of the present invention.

In the present invention, when the liquid level is high and the actual pump head is low, the liquid level detector detects this liquid level and outputs a signal to the controller. The controller outputs a control signal for attaining low-speed rotation of the electric motor to the frequency converter on the basis of the signal from the liquid level detector and a preset rotational speed for low-speed operation. Consequently, the pump is operated at a low actual pump head and begins to discharge the liquid. As a result, the liquid level gradually lowers, and this is detected by the liquid level detector. When a signal from the liquid level detector showing high liquid level is sent to the controller, the controller outputs a control signal for gradually raising the rotational speed to the frequency converter on the basis of a preset rotational speed increment rate. Consequently, the rotational speed of the electric motor gradually rises, causing the actual pump head to rise gradually.

When the controller outputs a control signal based on a preset rotational speed for high-speed operation, the electric motor rotates at the maximum rotational speed. When the liquid level detector detects that the liquid level has reached the lowest level, a control signal for suspending the electric motor may be output to the frequency converter through the controller. Thus, the pump may be suspended.

However, when it is desired to change the rotational speed of the electric motor at an intermediate liquid level, it is possible to further detect the intermediate liquid level and preset a rotational speed for an intermediate-speed operation and/or different rotational speed increment rates in the controller.

Further, it is possible to change the rotational speed of the electric motor at several intermediate liquid levels by detecting such intermediate levels and presetting different rotational speed for each intermediate-speed operation and/or different rotational speed increment rates in the controller.

In addition, it is possible to gradually lower the rotational speed of the electric motor from the maximum rotational speed to the suspension when the liquid level has reached the lowest level by presetting a rotational speed decreasing rate.

Further, it is possible to change the rotational speed decreasing rate at an intermediate liquid level or levels.

The rotational speed and rotational speed increment or decreasing rate of the electric motor depending on the liquid level are determined based on the required pump performance.

The above and other objects, features and advantages of the present invention will become more apparent from the following description when taken in conjunction with the accompanying drawings in which a preferred embodiment of the present invention is shown by way of illustrative examples.

BRIEF DESCRIPTION OF THE DRAWINGS

FIGS. 1 to 7 show one embodiment of the pump system according to the present invention, in which FIG. 1 shows the external appearance of the pump system;

FIG. 2 schematically shows small-sized combined septic tank equipment in which the pump system shown in FIG. 1 is installed;

FIG. 3 is a graph showing the pumping performance of pumps;

FIG. 4 shows the relationship between the liquid level and the rotational speed of the electric motor of the pump according to the embodiment;

FIG. 5 is a sectional front view of the pump system shown in FIG. 1 in a case where it has a brushless DC motor;

FIG. 6 1s a block diagram of a pump system having an induction motor;

FIG. 7 graphically shows the operation of the pump system, in which (A) is a graph showing motor rotational speed characteristics in relation to time, and (B) is a graph showing the operations of upper and lower float switches.

PREFERRED EMBODIMENT OF THE INVENTION

Figure 1:
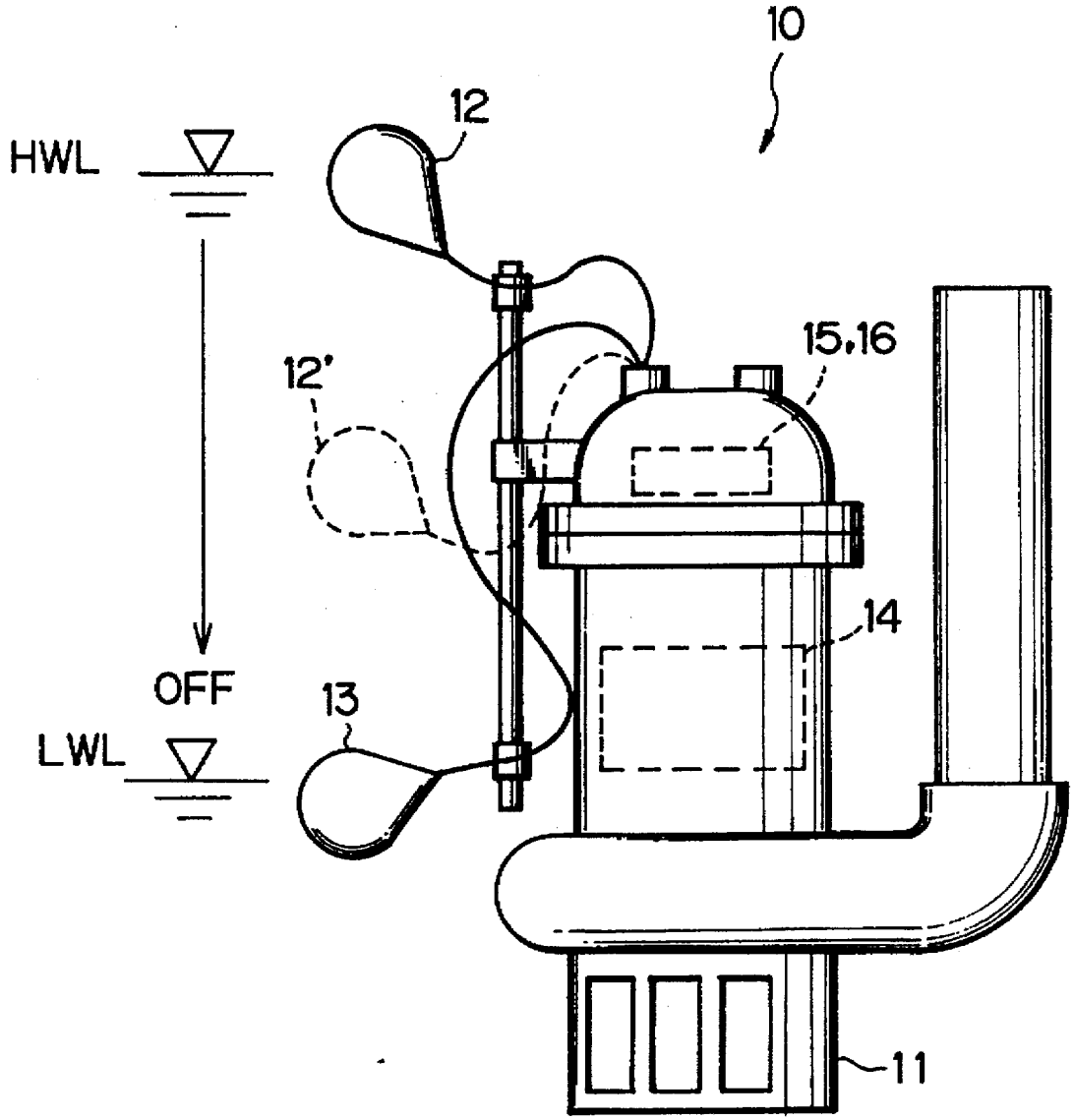
Figure 2:
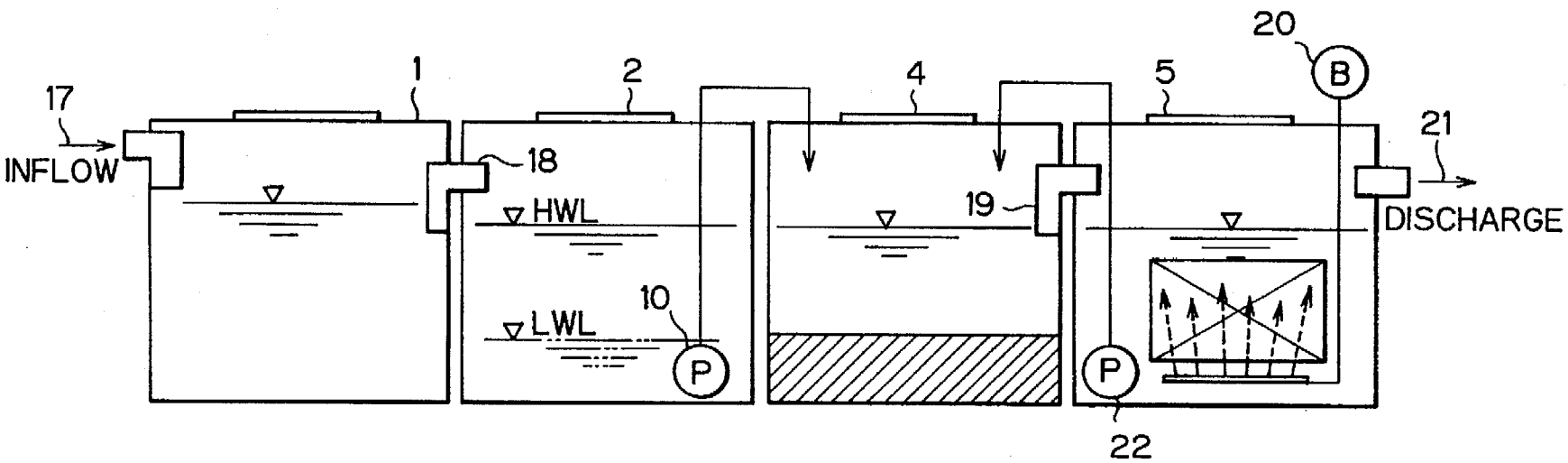
Figure 3:
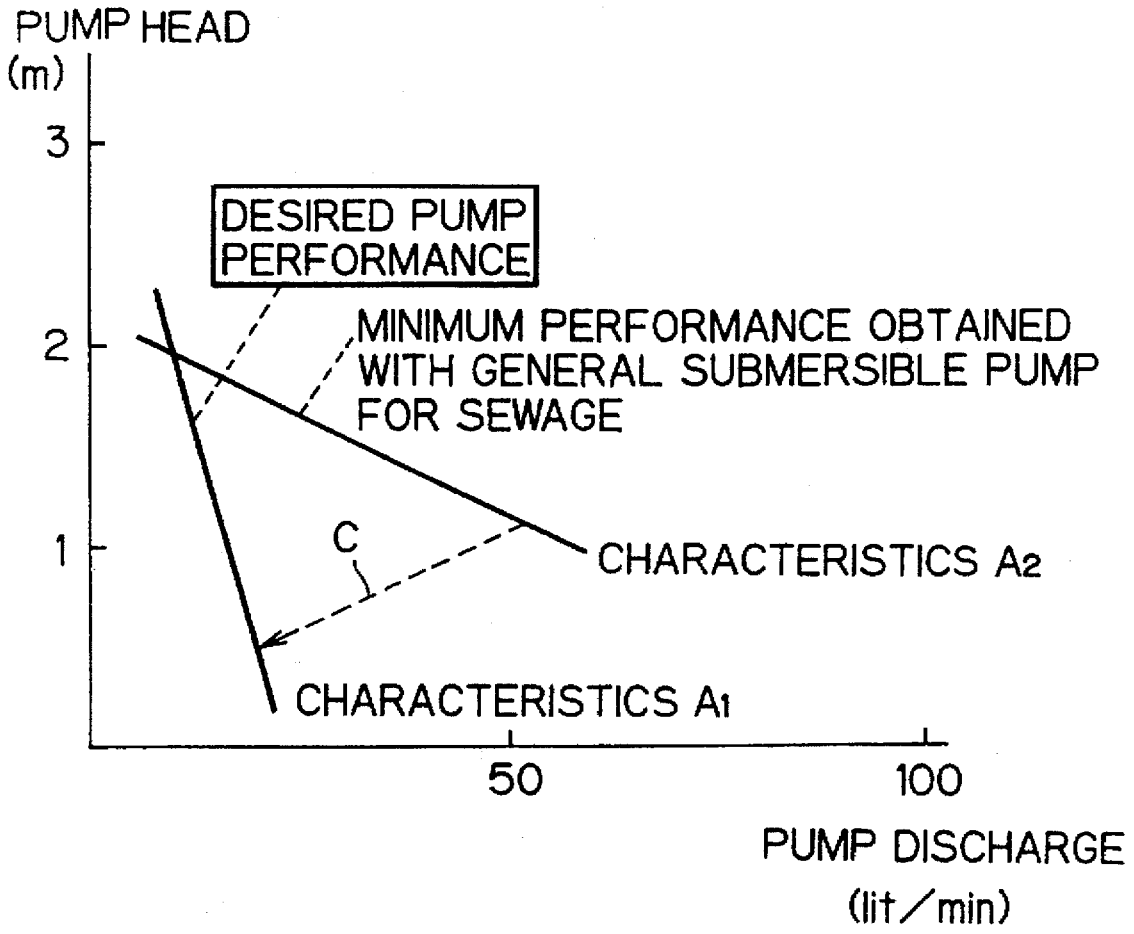
Figure 4:
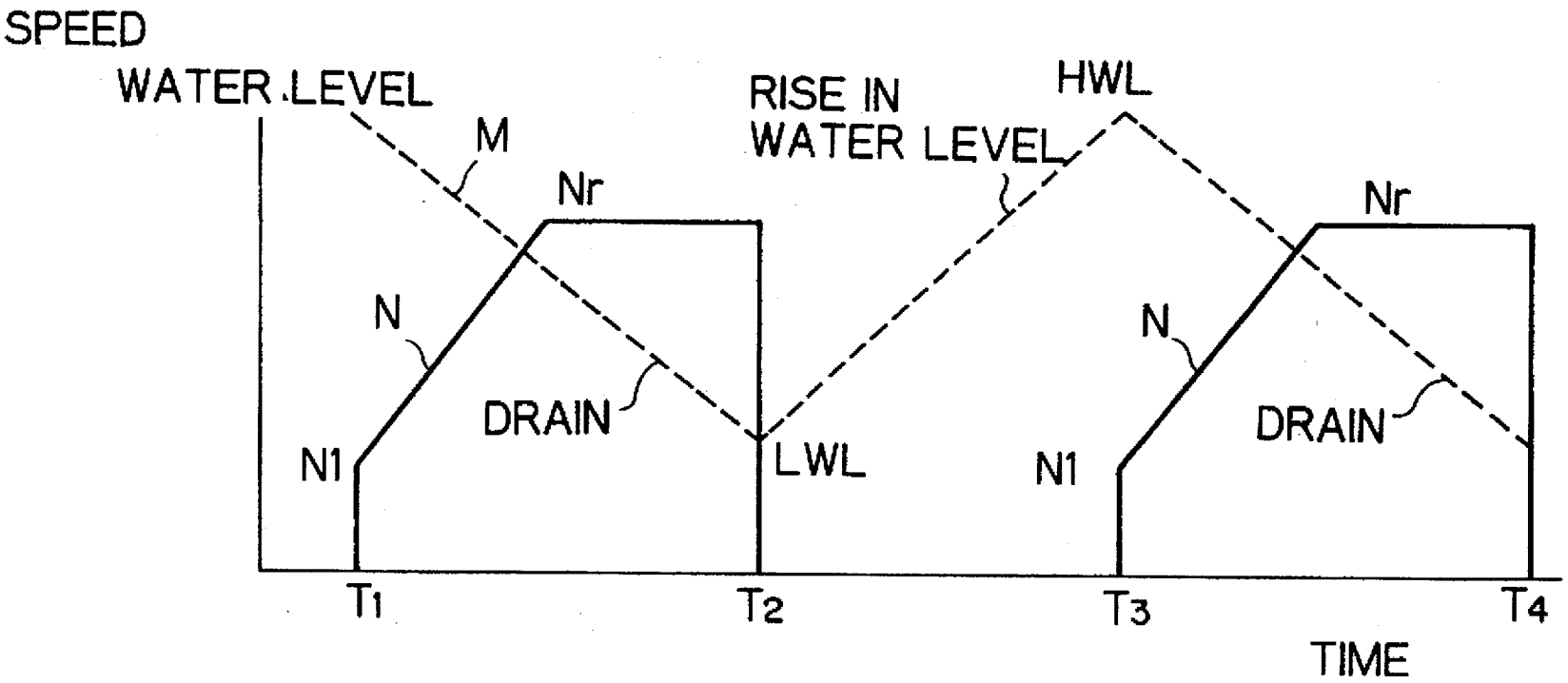
Figure 5:
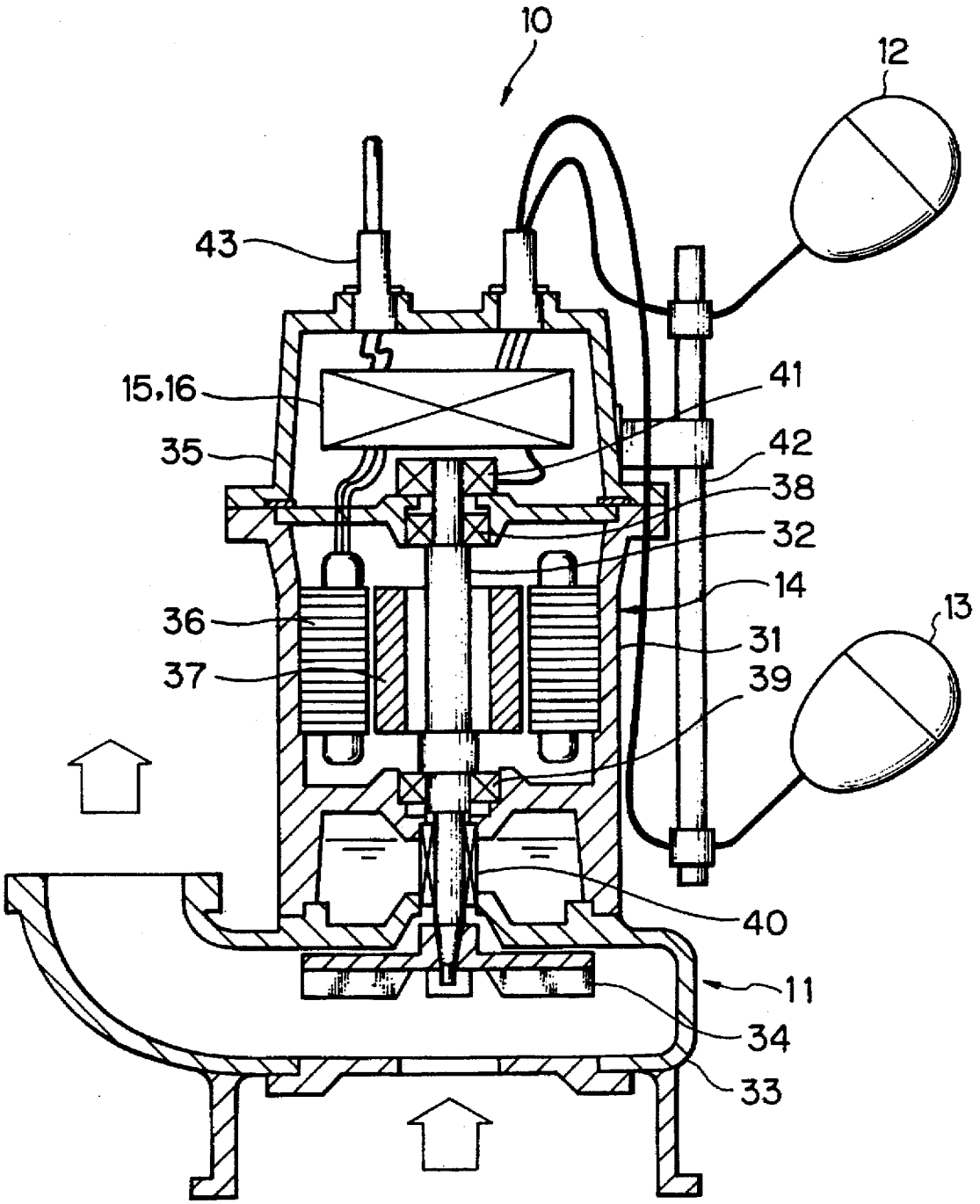
Figure 6:
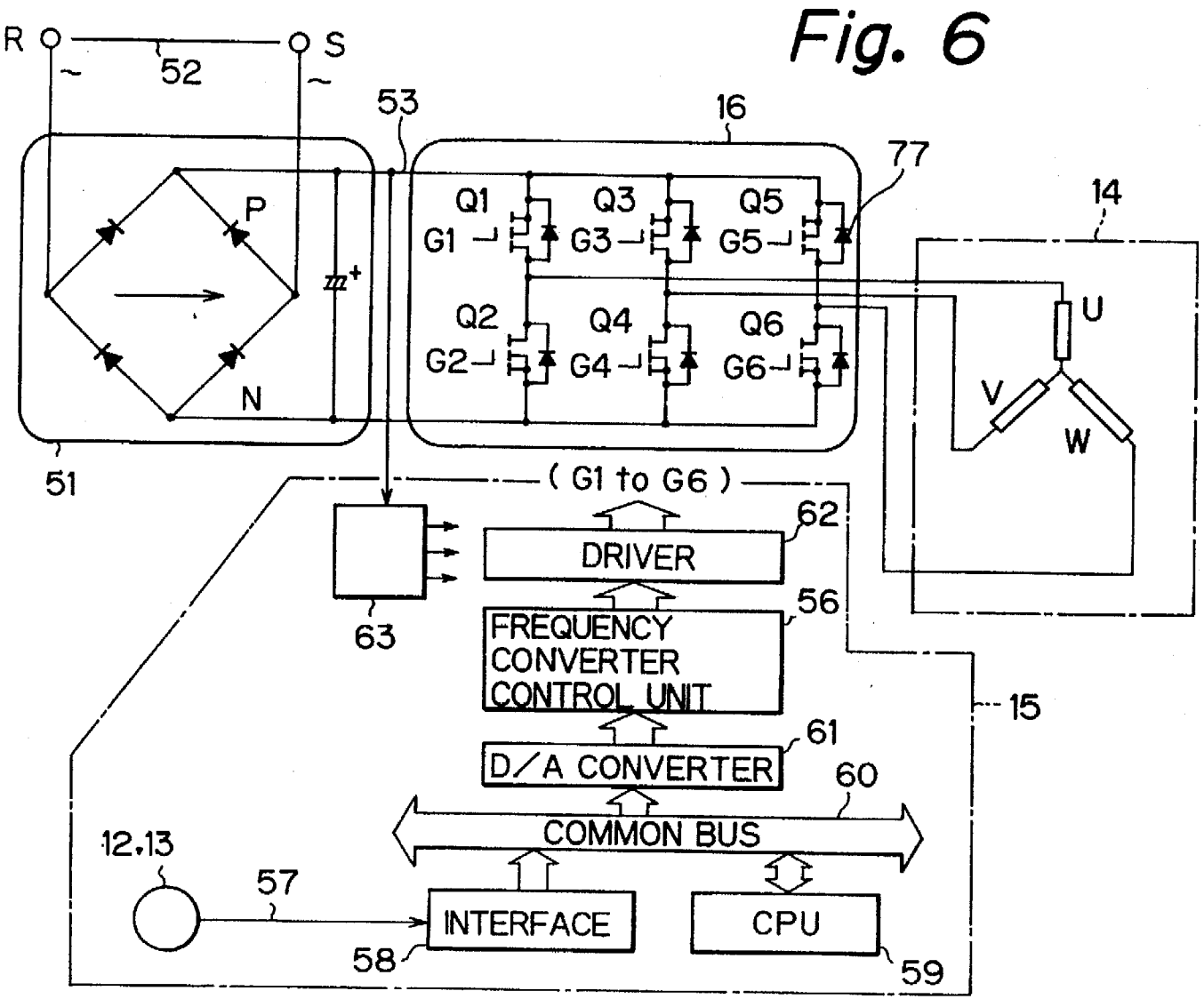
Figures 7A, 7B:
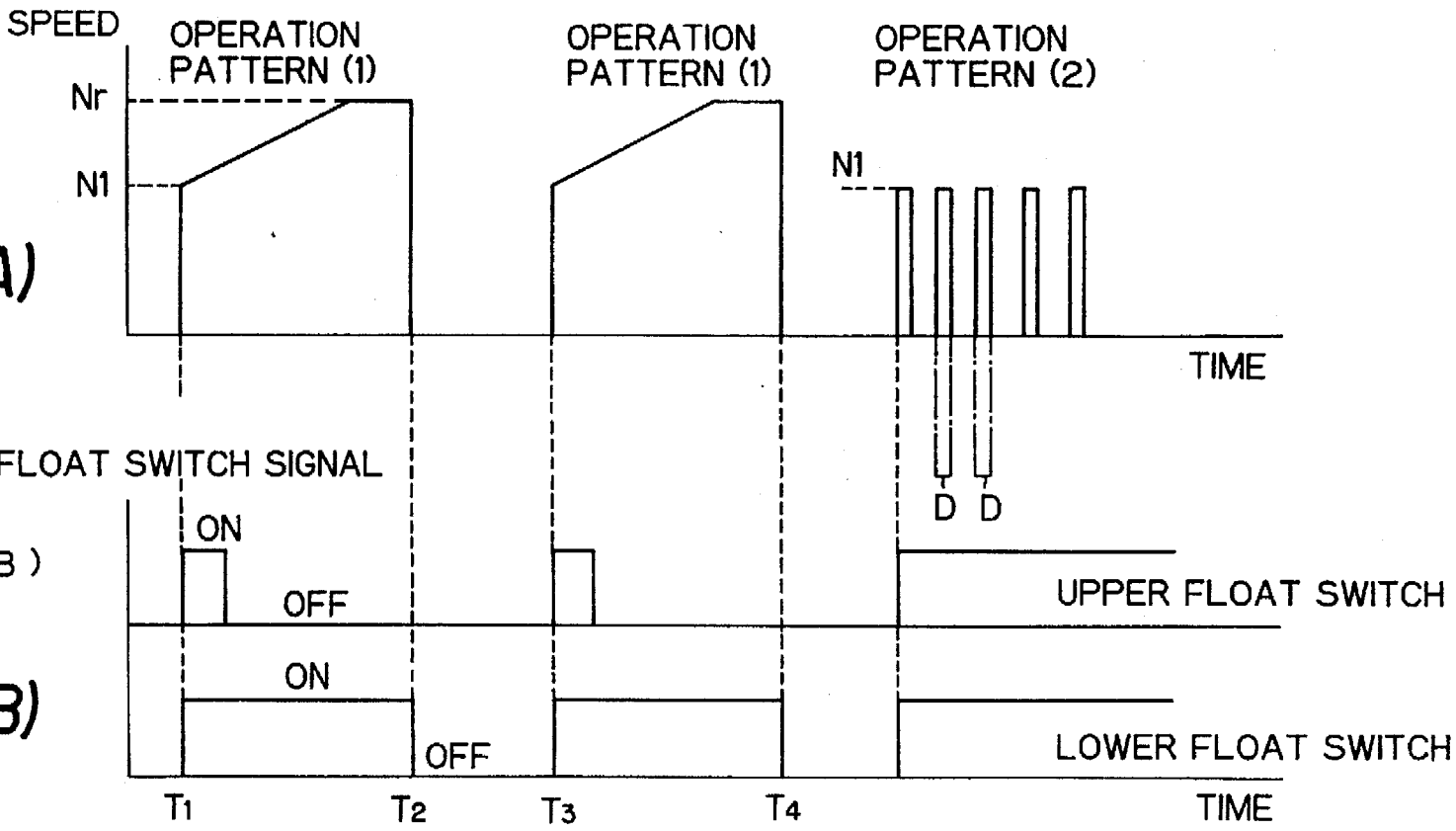
Figure 8:
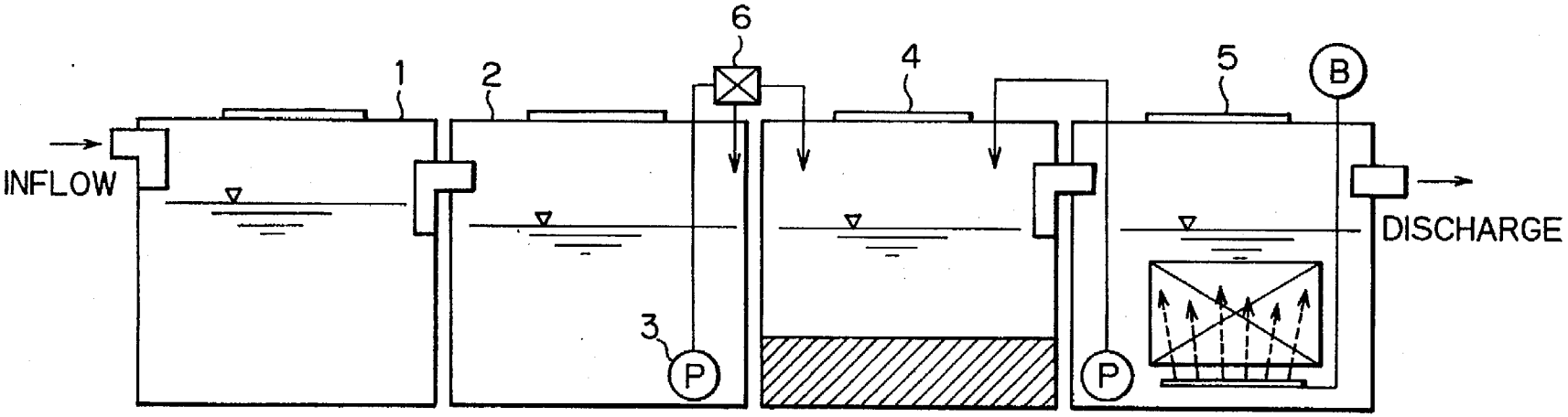
Fig. 8 PRIOR ART
FIG. 8 is a schematic view equivalent to FIG. 2, showing small-sized combined septic tank equipment in which a conventional pump is installed.

One embodiment of the present invention will be described below with reference to the accompanying drawings FIGS. 1 to 7. FIG. 1 shows the external appearance of a pump system according to this embodiment. FIG. 2 schematically shows small-sized combined septic tank equipment in which the pump system shown in FIG. 1 is installed. FIG. 3 is a graph showing pump performance. FIG. 4 shows the relationship between the liquid level and the rotational speed of the electric motor of the pump according to this embodiment. FIG. 5 is a sectional front view of a pump system having a brushless DC motor. FIG. 6 is a block diagram of a pump system having an induction motor. FIG. 7 is a graph showing the operation of this embodiment.

As shown in FIG. 1, a pump system 10 includes an ordinary pump 11 having a centrifugal impeller, including a vortex pump, which is driven to rotate by an electric motor 14, and a pair of upper and lower float switches 12 and 13, which constitute a liquid level detector for detecting a water level as liquid level. As the electric motor 14, an induction motor or a DC motor may be used. The upper float switch 12 is adapted to detect a high water level HWL, while the lower float switch 13 is adapted to detect a low water level LWL.

The pump system 10 further includes a controller 15 that outputs a control signal on the basis of preset rotational speeds for low and high-speed operations and a preset rotational speed increment rate, together with output signals from the upper and lower float switches 12 and 13, and a frequency converter 16 for varying the rotational speed of the electric motor 14 on the basis of the control signal from the controller 15.

The pump system 10 is used, for example, as a submersible motor pump system for sewage which is installed in small-sized combined septic tank equipment such as that shown in FIG. 2. In the small-sized combined septic tank equipment, sewage 17 flowing thereinto is temporarily stored in a raw sewage tank 1 and then flows into a flow control tank 2 through an overflow pipe 18. The pump system 10, shown in shown in FIG. 1, is installed in the sewage stored in the flow control tank 2 to supply the sewage into an anaerobic tank 4 by the operation of the pump system 10. By controlling the pump system 10, the water level in the flow control tank 2 is varied between the high water level HWL and the low water level LWL.

Sewage which has been treated by the action of anaerobic microorganisms in the anaerobic tank 4 moves to an aerobic contact aeration tank 5 through an overflow pipe 19. In the aerobic contact aeration tank 5, aeration is carried out by supplying air into the sewage by a blower 20, thereby treating the sewage by the action of aerobic microorganisms. Thereafter, the sewage is discharged as treated effluent 21. A pump 22 is installed in the aerobic contact aeration tank 5 to return part of the sewage to the anaerobic tank 4.

FIG. 3 is a graph showing the pumping performance obtained with a conventional submersible pump and that required for the pump system 10 installed in the flow control tank 2 of the small-sized combined septic tank equipment, in which the axis of abscissas represents the pump discharge, and the axis of ordinates represents the net pump head. In the graph, the characteristic curve $A_1$ shows the desired pump performance with which an approximately constant pump discharge can be obtained independently of the pump head, and the characteristic curve $A_2$ shows the minimum performance obtained with a conventionally used submersible sanitary sewage pump, which is driven by a 2-pole motor.

The characteristics $A_2$ provide an excessively high pump discharge in comparison to the characteristics $A_1$. However, if a general centrifugal submersible sanitary sewage pump having the characteristics $A_2$ is changed in design into a structure which provides a lower pump discharge, the pump head also lowers. Thus, practical performance can not be realized.

Accordingly, the pump system (see FIG. 1) according to the present invention uses a pump 11 having a centrifugal impeller, but changes the pump performance by controlling the operating rotational speed of the pump 11, thereby solving the problems of the prior art.

FIG. 4 is a graph showing the operation of the pump system 10, in which the axis of abscissas represents time, and the axis of ordinates represents the water level and the operating rotational speed. The solid line N shows change of the operating rotational speed. Reference symbols N1 and Nr denote rotational speeds for low and high-speed operations, respectively, which have been preset in the controller 15. The operation of the pump system 10 will be explained later.

FIG. 5 shows the internal structure of the pump system 10 having a brushless DC motor as the motor 14. As illustrated in the figure, the pump 11 includes an electric motor 14 having a main shaft 32 disposed in the center of a motor frame 31, a pump casing 33 secured to the bottom of the motor frame 31, a centrifugal impeller 34 disposed in the pump casing 33 and driven to rotate by the main shaft 32, a motor cover 35 that covers the top of the motor 14, and a frequency converter 16 and a controller 15 therefor, which are accommodated in the motor cover 85.

A stator 36 of the motor 14 is secured to the inner surface of the motor frame 31. A rotor 37 having a permanent magnet is secured to the main shaft 32. The main shaft 32 is rotatably supported by a pair of upper and lower bearings 38 and 39, which are attached to the motor frame 31. A mechanical seal 40 is attached to the main shaft 32 to seal the insides of the pump casing 83 and the motor 14. A position detector 41 for detecting the angular position of the rotor 37 1s accommodated in the motor cover 35.

A vertically extending support rod 42 is attached to the outside of the motor cover 35. The upper and lower float switches 12 and 13 are supported on the support rod 42 so that the positions of the float switches 12 and 13 can be adjusted. In addition, the motor cover 35 supports a power cable 43 which is connected to the frequency converter 16 and which extends through the motor cover 35.

FIG. 6 shows an arrangement in which the pump system 10 has an induction motor as the above-described motor 14.

A rectifying and smoothing circuit 51 has a single-phase bridge rectifier circuit for rectifying and smoothing an alternating current from an AC power supply 52 to obtain a direct current 53. The direct current 53 obtained by the rectifying and smoothing circuit 51 is supplied to the frequency converter 16. The frequency converter 16, which is called voltage-type inverter, includes six switching elements $Q_1$ to $Q_6$ having self-turn-off capability and six feedback diodes 77, which are connected together in the form of a three-phase bridge. The control of the output frequency is effected by controlling the ON/OFF timing of the switching elements $Q_1$ to $Q_6$. In this embodiment, power transistors are used as the switching elements $Q_1$ to $Q_6$.

A liquid level signal 57 that is detected by the upper and lower float switches 12 and 13 is output to an interface 58. A CPU 59 is stored with a preset initial rotational speed N1 as a rotational speed for low-speed operation, a preset maximum rotational speed Nr as a rotational speed for high-speed operation, and a preset rotational speed increment rate.

The CPU 59, which is connected to the interface 58 by a common bus 60, executes calculation on the basis of the preset rotational speeds N1 and Nr and rotational speed increment rate, together with the signal 57, from the upper and lower float switches and outputs the result of the calculation to a D/A converter 61 through the common bus 60. The D/A converter 61 converts the input digital signal to a voltage or a current and then outputs a speed command to a frequency converter control unit 56. The frequency converter control unit 56 outputs a control signal to the frequency converter 16 through a driver 62. It should be noted that the controller 15 is provided with a controller power supply circuit 68 as a power supply for the controller 15, which is connected to the line for the direct current 53.

FIG. 7 graphically shows the operation of this embodiment. In the figure, (A) is a graph showing motor rotational speed characteristics in relation to time, and (B) is a graph showing the ON/OFF operations of the upper and lower float switches 12 and 13. The operation pattern (1) in the figure shows the operation of the pump system under normal conditions, and the operation pattern (2) shows the pump system operation under abnormal conditions, for example, when there is a failure due to choking of the pump with a foreign matter.

The operation of this embodiment will be explained below with reference to FIGS. 3, 4, 6 and 7.

In the case of the operation pattern (1) in FIG. 7, it is assumed that the water level in the flow control tank 2 is above the high water level HWL at time $T_1$. At this time, both the upper and lower float switches 12 and 13 face upward and output an ON signal as the liquid level signal 57, and the actual pump head is low. In this case, the controller 15 outputs a control signal to the frequency converter 16 so that the pump 11 to be started at a rotational speed N1, which is lower than the ordinary motor rotational speed in a system with no frequency converter 16 (that is, the motor rotational speed in the conventional system). After the starting of the pump 11, the pump system 10 sends the sewage from the flow control tank 2 to the anaerobic tank 4. Accordingly, the water level gradually lowers, and the upper float switch 12 outputs an OFF signal. As the water level lowers as a result of the pumping operation of the pump system 10, it causes the actual pump head of the flow control tank 2 to rise gradually. Consequently, it becomes impossible to generate a pump discharge pressure corresponding to the raised actual pump head with the low rotational speed N1 used in the early stages of starting. Therefore, to avoid such a disadvantage, in this embodiment, at the same time as the pump 11 is started, the rotational speed of the motor 14 is raised either stepwisely or continuously at a predetermined time rate according to a command from the frequency converter 16, which is under the control of the controller 15 which outputs a signal based on the preset rotational speed increment rate. And after a predetermined time, a command for the maximum rotational speed Nr is issued. The maximum rotational speed Nr should preferably be a rotational speed corresponding to the maximum actual pump head of the small-sized combined septic tank equipment.

As the pump 11 is operated in this way, the water level gradually lowers and eventually reaches the low water level LWL, as shown by the broken line M in FIG. 4. Consequently, the lower float switch 13 faces downward, causing the liquid level signal 57 to be OFF (time $T_2$). At this time, the controller 15 outputs a control signal for suspending the motor 14 to the frequency converter 16. Thus, the pump system 10 is suspended, and it repeats the above-described operation during the period of time from time $T_3$ at which the water level returns to the high water level HWL to time $T_4$ (see FIGS. 4 and 7).

Thus, in this embodiment the operating rotational speed of the pump 11 is gradually shifted from the low speed to the high speed, thereby changing the pump performance, for example, from the characteristic $A_2$ to the characteristics $A_1$ in FIG. 3 as shown by the arrow C.

Accordingly, in this embodiment it is possible to realize pumping performance required for a pump system used in the flow control tank 2. Therefore, it becomes unnecessary to provide a flow control device which has heretofore been used, resulting in reduction of the size and cost of the pump system 10. In addition, since the pump 11 has the centrifugal impeller 84, no wear or noise problem arise. Further, since the operating rotational speed of the pump 11 is changed according to then need actual pump head, it is possible to avoid power consumption. Although the operation of the embodiment has been described with regard to a system employing an induction motor, it should be noted that the same is the case with a system that employs a brushless DC motor.

Next, an operation that takes place when the operation pattern (2) shown in FIG. 7 is used, that is, when the pump 11 is subject to abnormal conditions, will be explained. When the pump 11 is subject to abnormal conditions, for example, when it becomes choked with foreign matter, the controller 15 In FIG. 6 outputs a control signal so that the motor 14 tries to start the pump 11, and if the pump 11 does not clear, the motor 14 repeatedly retries to start the pump 11 after stopping for a predetermined time, and if the pump 11 still does not clear after a predetermined number of attempts at restarting, the operation of the motor 14 is suspended. Alternatively, the controller 15 may output a control signal when the motor 14 does not clear to start the choked pump 11 so that the second and following tries for starting are carried out by reversely rotating the motor 14, as shown in chain line in FIG. 7.

More specifically, when the water level is high, the controller 15 issues a command for the initial rotational speed N1 on the basis of the ON signals from the upper and lower float switches 12 and 13. However, when the position detector 41 does not detect rotational motion of the rotor 37, a further attempt is made after a predetermined time. If normal operation is not attained even after the number of attempts at restarting the pump 11 reaches a predetermined value (5 in FIG. 7), the operation of the motor 14 is suspended to protect it irrespective of whether the signals from the upper and lower float switches 12 and 13 are ON or OFF. It is even more preferable to attempt to start the pump by reversely rotating the motor 14, as shown by the chain lines D in FIG. 7, with a view to facilitating clearing the pump 11.

It should be noted that the pump system of the present invention may also be applied to a pump system installed on the ground in addition to submersible motor pump systems. In this case, float switches 12, 13 are separated from a pump body and installed in the flow control tank 2. The pump system of the invention can also be used for a liquid other than sewage.

Also, it should be noted that the operational speed pattern of the electric motor is not limited to the pattern explained above.

For example, when it is desired to change the rotational speed of the electric motor at an intermediate liquid level, it is possible to further detect the intermediate liquid level by means of an intermediate float switch (12' in FIG. 1) and the controller can output a preset rotational speed and/or preset different rotational speed increment rate for an intermediate-speed operation.

Further, it is possible to change the rotational speed of the electric motor at several intermediate liquid levels by detecting such intermediate levels by float switches and outputting a preset different rotational speed and/or preset different rotational speed increment rate for each intermediate-speed operation.

In addition, it is possible to gradually lower the rotational speed of the electric motor from the maximum rotational speed to the suspension when the liquid level has reached the lowest level by presetting a rotational speed decreasing rate in the controller. Also, it is possible to change the rotational speed decreasing rate at intermediate liquid level or levels.

These operational speed patterns of the electric motor can be determined based on the required pump performance.

The present invention, arranged as described above, is capable of exhibiting a required pumping performance and of controlling the flow rate and the pump head. In addition, it is possible to prevent power consumption, wear and generation of noise and to reduce the overall size and cost of the pump system.

What is claimed is:

1. A pump system comprising:

a pump having a centrifugal impeller rotated by means of an electric motor;

a liquid level detector for detecting a liquid level;

control means for outputting a control signal on the basis of preset rotational speeds and a preset rotational speed increment rate, in response to an output signal from a liquid level detector, and frequency converter means for initiating operation of said electric motor and for varying the rotational speed thereof on the basis of said control signal from said control means, wherein said preset rotational speeds include at least speeds for low and high-speed operations of said pump and said rotational speed of said electric motor is varied in accordance with said preset rotational speed increment rate from said low-speed operation to said high-speed operation.

2. A pump system as claimed in claim 1, wherein said liquid level includes predetermined high and low-liquid levels, and said electric motor is initially driven at said preset low-speed operation at said predetermined high-liquid level and is suspended at said predetermined low-liquid level.

3. A pump system as claimed in claim 2, wherein said liquid level detector includes a pair of upper and lower float switches.

4. A pump system as claimed in any one of claims 1 to 3, wherein said pump system is a submersible pump system.

5. A pump system as claimed in claim 4, wherein said control means and said frequency converter means are incorporated in said pump.

6. A pump system as claimed in claim 1, wherein said motor is a brushless DC motor or an induction motor.

7. A pump system as claimed in claim 1, further comprising means for detecting choking of said pump, means in said control means operative to output a control start signal to said electric motor when said pump is choked so that said electric motor tries to start said choked pump, means effective to repeat said control start signal to said electric motor intermittently and if said pump fails to clear, means for suspending the operation of said electric motor if said pump fails to start after a predetermined number of attempts.

8. A pump system, as claimed in claim 1, further comprising means for detecting choking of said pump, means in said control means operative to output a control start signal to said electric motor when said pump is choked so that said electric motor tries to start said choked pump, means effective to repeat said control start signal to said electric motor is said pump fails to clear, and means for effecting a reverse rotation start of said electric motor by said control start signal if said pump fails to clear on a second or subsequent attempt at restarting.

9. A pump system as claimed in claim 1, wherein said pump system is used as a submersible motor pump system in small-sized combined septic tank equipment including a flow control tank and an anaerobic tank, wherein said pump system is installed in said flow control tank for supplying sewage from said flow control tank into said anaerobic tank.

10. A pump system as claimed in claim 1, wherein said pump system is used as a submersible motor pump system in a small-sized combined septic tank equipment including a raw sewage tank, a flow control tank, an aerobic tank and an aerobic contact aeration tank arranged in series, wherein said pump system is installed in said flow control tank for supplying sewage from said flow control tank into said anaerobic tank.

11. A method for operating a pump system comprising a pump having a centrifugal impeller rotated by means of an electric motor; said method comprising steps of detecting a liquid level to be pumped out;

outputting a control signal on the basis of preset rotational speeds and a preset rotational speed increment rate in response to said detected liquid level, to initiate operation of said electric motor and varying the rotational speed of said electric motor on the basis of said output control signal, wherein said preset rotational speeds include at least speeds for low and high-speed operations of said pump including varying said rotational speed of said electric motor with said preset rotational speed increment rate from said low-speed operation to said high-speed operation.

12. A method for operating a pump system as claimed in claim 11, wherein said liquid level includes predetermined high and low-liquid levels, including the steps of driving said electric motor at said preset low-speed operation at said predetermined high-liquid level and suspending operation of said electric motor at said predetermined low-liquid level.

13. A method for operating a pump system comprising a pump having a centrifugal impeller rotated by means of an electric motor; said method comprising steps of detecting a liquid level to be pumped out;

outputting a control signal on the basis of preset rotational speeds and a preset rotational speed increment rate in response to said detected liquid level, to initiate operation of said electric motor and varying the rotational speed of said electric motor on the basis of said output control signal, wherein said preset rotational speeds include at least speeds for low and high-speed operations of said pump including varying said rotational speed of said electric motor with said preset rotational speed increment rate from said low-speed operation to said high-speed operation; and comprising the further steps of detecting choking of said pump, attempting to start said choked pump by means of said electric motor when said pump is choked, repeatedly attempting to start said pump by means of said electric motor after stopping for a predetermined time if said pump does not clear, and suspending the operation of said electric motor if said pump does not clear even after having attempted to start said pump a predetermined number of time.

14. A method for operating a pump system as claimed in claim 13, wherein said liquid level includes predetermined high and low-liquid levels, including the steps of driving said electric motor at said preset low-speed operation at said predetermined high-liquid level, and suspending operation of said electric motor at said predetermined low-liquid level.

15. A method for operating a pump system comprising a pump having a centrifugal impeller rotated by means of an electric motor; said method comprising steps of detecting a liquid level to be pumped out;

outputting a control signal on the basis of preset rotational speeds and a preset rotational speed increment rate in response to said detected liquid level, to initiate operation of said electric motor and varying the rotational speed of said electric motor on the basis of said output control signal, wherein said preset rotational speeds include at least speeds for low and high-speed operations of said pump including varying said rotational speed of said electric motor with said preset rotational speed increment rate from said low-speed operation to said high-speed operation; and comprising the further steps of detecting choking of said pump, attempting to start said choked pump by means of said electric motor when said pump is choked, carrying out the second and subsequent attempts at restarting by reversely rotating said electric motor if said pump does not clear.

16. A method for operating a pump system as claimed in claim 15, wherein said liquid level includes predetermined high and low-liquid levels, including the steps of driving said electric motor at said preset low-speed operation at said predetermined high-liquid level, and suspending operation of said electric motor at said predetermined low-liquid level.

17. In a method of operating a pump system in a small-sized combined septic tank equipment including a flow control tank and an anaerobic tank, wherein said pump system is installed in said flow control tank for supplying sewage from said flow control tank into said anaerobic tank, wherein said pump system is operated in accordance with a method comprising the steps of:

detecting a liquid level to be pumped out;

outputting a control signal on the basis of preset rotational speeds and a preset rotational speed increment rate in response to said detected liquid level, to initiate operation of said electric motor and varying the rotational speed of said electric motor on the basis of said output control signal, wherein said preset rotational speeds include at least speeds for low and high-speed operations of said pump including varying said rotational speed of said electric motor with said preset rotational speed increment rate from said low-speed operation to said high-speed operation.

18. A method for operating a pump system as claimed in claim 17, wherein said liquid level includes predetermined high and low-liquid levels, including the steps of driving said electric motor at said preset low-speed operations at said predetermined high-liquid level, and suspending operation of said electric motor at said predetermined low-liquid level.

19. A method for operating a pump system as claimed in claim 18 comprising the further steps of:

detecting choking of said pump, attempting to start said choked pump by means of said electric motor when said pump is choked, repeatedly attempting to start said pump by means of said electric motor after stopping for a predetermined time if said pump does not clear, and suspending the operation of said electric motor if said pump does not clear even after having attempted to start said pump a predetermined number of times.

20. A method for operating a pump system as claimed in claim 19 including the step of carrying out the second and subsequent attempts at restarting by reversely rotation said electric motor of said pump does not clear.

21. In a method of operating a pump system in small-sized combined septic tank equipment including a raw sewage tank, a flow control tank, an anaerobic tank and an aerobic contact aeration tank arranged in series, wherein said pump system is installed in said flow control tank for supplying sewage from said flow control tank into said anaerobic tank, wherein said pump system is operated in accordance with a method comprising steps of:

detecting a liquid level to be pumped out;

outputting a control signal on the basis of preset rotational speeds and a preset rotational speed increment rate in response to said detected liquid level to initiate operation of said electric motor, and varying the rotational speed of said electric motor on the basis of said output control signal, wherein said preset rotational speeds include at least speeds for low and high-speed operations of said pump including varying said rotational speed of said electric motor with said preset rotational speed increment rate from said low-speed operation to said high-speed operation.

22. A method for operating a pump system as claimed in claim 21, wherein said liquid level includes predetermined high and low-liquid levels, including the steps of driving said electric motor at said preset low-speed operation at said predetermined high-liquid level, and suspending operation of said electric motor at said predetermined low-liquid level.

23. A method for operating a pump system as claimed in claim 22 comprising the further steps of:

detecting choking of said pump, attempting to start said choked pump by means of said electric motor when said pump is choked, repeatedly attempting to start said pump by means of said electric motor after stopping for a predetermined time if said pump does not clear, and suspending the operation of said electric motor if said pump does not clear even after having attempted to start said pump a predetermined number of times.

24. A method for operating a pump system as claimed in claim 23 including the step of carrying out the second and subsequent attempts at restarting by reversely rotating said electric motor if said pump does not clear.

* * * * *